United States Patent [19]

Ulery

[11] 3,954,576

[45] May 4, 1976

[54] ELECTROLYTIC PROCESS FOR PREPARING TETRAVALENT ALKYLTIN HALIDE COMPOSITIONS

[75] Inventor: Harris Ellsworth Ulery, Newark, Del.

[73] Assignee: E. I. Du Pont de Nemours and Company, Wilmington, Del.

[22] Filed: July 25, 1974

[21] Appl. No.: 491,778

[52] U.S. Cl. ..... 204/59 QM

[51] Int. Cl.[2] ..... C25B 3/12; C25B 11/00; B01K 1/00

[58] Field of Search ..... 204/59 QM, 59 L

[56] References Cited

UNITED STATES PATENTS 3,823,077 7/1974 Ulery ..... 204/59 QM

*Primary Examiner*—F. C. Edmundson

*Attorney, Agent, or Firm*—James A. Costello

[57] ABSTRACT

An electrolytic process for preparing tetravalent alkyltin chloride or bromide compositions by electrolyzing a $C_{1-10}$ alkyl chloride or bromide in contact with a liquid electrolyte containing chloride or bromide ions and a tin cathode in an undivided cell at a current density sufficiently high to effect formation of said compositions.

12 Claims, No Drawings

ELECTROLYTIC PROCESS FOR PREPARING TETRAVALENT ALKYLTIN HALIDE COMPOSITIONS

BACKGROUND OF THE INVENTION

1. Field of the Invention

This invention relates to a novel electrolytic process for preparing alkyltin halide compositions particularly dialkyltin dihalides and trialkyltin halides. In one embodiment of the invention, the corresponding solid oxides are produced which are easily separated from the liquid portion of the reaction mixture.

2. Description of the Prior Art

One class of commercially important alkyltin compositions comprises tetravalent alkyltin compositions wherein the unsatisfied valences are satisfied by halogen atoms. Such compositions find wide and well-known utility as, for instance, catalysts for esterifications and as intermediates through which other tetravalent alkyltin compositions are prepared for specialized uses.

Dialkyltin dihalides, such as dibutyltin dichloride and dioctyltin dichloride are becoming increasingly important as intermediates for preparing such commercial products as dibutyltin diacetate, dibutyltin dilaurate, dioctyltin dilaurate and the like and as independent articles of commerce.

Existing methods for preparing the dialkyltin dihalides involve costly and time consuming operations. One such process involves first preparing the tetraalkyltins, then degrading them to the dialkyltin compositions, for example, by reaction with halogen. Another process involves reacting preformed tetraalkyltin with a stannic halide to form redistribution mixtures of the various possible tetravalent alkyltin halides. Still another process involves direct reaction of tin with alkyl halides. This process, even with the use of catalysts, requires rather high temperatures and pressures and extended periods of time to effect the desired results.

U.S. Pat. No. 3,197,382 discloses the preparation of tetraalkyltins (among other organo metal compositions) by the electrolytic reduction of alkyl esters (including alkyl halides) at a tin cathode (or other sacrificial metal cathode according to the organo metal to be prepared). Cleaving alkyl groups from the tetraalkylated product by breaking the alkyltin bond in order to obtain alkyltins having less than four alkyls per tin atom would constitute a waste of the electricity already utilized and required to form those alkyltin bonds in the electrolytic process.

Russian Patent No. 184853 discloses preparation of alkyltin halides by electrolyzing a mixture of alkyl halides and tin salts at a magnesium cathode, e.g., electrolyzing butyl bromide and tin chloride in butyl acetate in contact with a magnesium cathode and a graphite anode while gradually adding bromine during the electrolysis yielded a mixture of dibutyltin dibromide and tributyltin bromide.

A process has now been discovered for preparing alkyltin compositions containing less than four alkyl groups per tin atom, which process, among other things, (1) avoids the stringent conditions of temperature and pressure required to produce alkyltin halides by direct reaction of tin with alkyl halides; (2) avoids the necessity of proceeding via cleavage of alkyl group from tetraalkyltins to the desired compositions.

SUMMARY OF THE INVENTION

This invention converns a process for preparing at least one tetravalent alkyltin halide composition having two to three alkyl groups and one to two halide groups per tin atom, comprising electrolyzing a $C_1$ to $C_{10}$ alkyl halide reactant in contact with a tin cathode, in a liquid electrolyte containing a source of halide ions (current-carrier) in an undivided cell at a current density of from about 0.02 to 0.2 amp./cm$^2$, preferably at least about 0.05 amp./cm.$^2$.

Both trialkyltin halide and dialkyltin dihalide are produced by the process of this invention. In general, use of high current densities and increasing the size and bulkiness of the alkyl portion of the alkylating agent appears to favor dialkyltin dihalide formation over trialkyltin halide formation. The dialkyltin dihalides and trialkyltin monohalides are produced by including in the electrolyte a source of halide ions, anodically oxidizing said halide ions while cathodically reducing said alkyl halide, and thereby reacting in situ the anodic and cathodic reaction products. By "halide" as employed herein is meant chloride and bromide.

Conventional electrolytic cells are contemplated to be employed herein. Such cells are composed of an anode and a cathode in a container forming a single compartment cell. The cathode will be tin in a form presenting a large surface area for a high rate of alkyltin formation. The anode will be any inert electrode material that is resistant to corrosion by chlorine and bromine. Suitable anodes include platinum, Pt on Ti, Pt on Ta, and carbon. Usually, the effective surfaces of the electrodes will be spaced apart by about 0.2 to 2 cm.

Cell operation, in the presence of the electrolyte, the current-carrier, and the alkyl chloride or bromide reactant, comprises passing an electrolyzing direct electric current from the cathode, through the electrolyte to the anode.

DETAILS OF THE INVENTION

Whatever the product selected for production, the reduction of alkyl chloride or bromide as defined, is the primary step underlying the various embodiments. This requires utilization of an electrolyte which is capable of carrying current to a degree sufficient to allow the reaction to proceed at a practical rate, and is otherwise substantially inert. Normally, such electrolyte will comprise an alkyl halide, a current-carrier providing chloride or bromide ions and a solvent component for said carrier which is substantially inert to the other components of the cell in which the process is carried out and is so constituted that it is not reduced in preference to the alkyl halide at the tin cathode.

The electrolyte is an alkyl halide-electrolyte composition consisting essentially of a $C_1$–$C_{10}$ alkyl halide and a supporting conductive medium which does not interfere with the primary step of alkylating tin. To be non-interfering, the composition should contain no constituents which are destructive of the tin cathode or which are more easily reduced (than the alkyl halide) at the tin cathode, so as to prevent alkyltin formation. During the electrolysis, halide ion is produced at the cathode while at the anode halide ion is oxidized to halogen.

The dialkyltin dihalides and the trialkyltin halides are believed to form mainly from reactions of the halogen produced at the anode with the various alkyltin compounds produced at the cathode. For example, tetraalkyltin can react with one mole of halogen to form trialkyltin halide and with two moles to form dialkyltin dihalide. Similarly, hexaalkylditin is cleaved by a halogen molecule to produce two molecules of trialkyltin halide. Dialkyltin dihalide can also arise from the combination in situ of halogen produced at the anode with dialkyltin produced at the cathode, while trialkyltin halide can also result from reaction in situ of dialkyltin with alkyl halide and from disproportionation between dialkyltin dihalide and tetraalkyltin.

The operating voltage is not critical so long as it is sufficient to overcome the resistance of the cell (including that of the electrolyte) and to reduce the alkyl halide at the cathode and to simultaneously effect the cell-balancing reaction of the anode, thereby establishing current flow. Normally a potential difference of at least about 3 volts and not more than 40 volts is required for satisfactory operation.

The alkyl halide reactant contains up to 10 carbon atoms, preferably at least two carbon atoms, and can be straight-chain or branched-chain. Included are methyl chloride, ethyl chloride, n-propyl chloride, isopropyl chloride, n-butyl chloride, isobutyl chloride, isoamyl chloride, n-hexyl chloride, n-octyl chloride, isooctyl chloride, n-decyl chloride, and the corresponding bromides. One preferred class comprises the $C_4$ to $C_8$ primary alkyl chlorides and bromides, particularly the n-butyl and n-octyl compounds for reasons of the established commercial importance of the butyltin and octyltin derivatives.

The current-carrier should provide current-carrying chloride or bromide ions and be soluble in the electrolyte composition to the extent necessary to impart conductivity of at least 0.001 ohm $cm^{-1}$, preferably at least 0.01 ohm $cm^{-1}$, and as high as practical. Also, the current-carrier should have a reduction potential sufficiently high so that it is not preferentially reduced to prevent the alkylation of tin from occurring. The chloride or bromide ion source serves both as current-carrier and electron transfer component to the anode, e.g. $2Br^- - 2e \rightarrow Br_2$.

Satisfactory current-carriers include quaternary ammonium salts such as tetraalkyl ammonium halides which are well known for their use as current-carriers in electrochemical processes. They have relatively high reduction potentials and are capable of imparting conductivity to aqueous and nonaqueous solvents. Tetraalkyl ammonium chlorides and bromides wherein each alkyl has one to 18 carbons constitute a preferred class and particularly preferred are those having from one to four carbons, more particularly one to two carbons. Some representative compounds are: tetramethyl ammonium chloride, tetraethyl ammonium chloride, tetra(isopropylammonium) chloride, tetra(n-butyl ammonium) chloride, dimethyldioctadecyl ammonium chloride, trimethyloctadecyl ammonium chloride and the corresponding bromides.

Other halide sources can be used as the current-carrier provided they do not interfere with the alkylation reaction. For example, metal halides such as the alkali metal chlorides and bromides can be used but are less preferred since the metal component tends to be electrodeposited at the cathode. This not only consumes current but tends to produce sludge owing to cathode breakup.

The quaternary ammonium halide and metal halide current-carriers tend to form complexes with the alkyltin halide products, which may complicate the recovery of said products directly in the alkyltin halide form. Such tendency towards complex formation can be counteracted, for example, by increasing the size of the alkyl group of the alkylating agent (which is preferably ethyl or larger for this purpose) or by increasing the size of the alkyl groups of the quaternary ammonium halide (which is preferably isopropyl, butyl or higher alkyl as defined).

Dialkyltin dichlorides and dibromides and trialkyltin chlorides and bromides as a class are also suitably conductive for use as current-carriers in this invention, particularly the di($C_1$–$C_2$ alkyl)tin dichlorides and dibromides because of their greater conductivity. Use of alkyltin halide current-carriers avoids the problem of complex formation and of separating the alkyltin halide products from the electrolyte and thus greatly facilitates recovery of products.

The dialkyltin dihalide and trialkyltin halide can be recovered as such on distillation of the electrolyte or as the corresponding oxides by hydrolyzing the reaction mixture with alkali under conditions well-known in the art for converting these compounds to their oxides and recovering the dialkyltin oxide and the bis(trialkyltin) oxide by filtration, etc. This latter technique is especially useful where complex formation between the alkyltin halide products with current-carrier halide makes impractical or uneconomic the recovery of the dialkyltin dihalide and the trialkyltin halide products themselves. The electrolyte insoluble dialkyltin oxide and bis(trialkyltin) oxide products can be separated from one another by known means and, of course, have well-known utility.

Since the alkyl chloride or bromide itself is not usually sufficiently polar to serve as solvent for the current-carrier, the electrolyte composition will ordinarily contain an organic polar solvent, which can be an aqueous or nonaqueous system. Preferably, the solvent is capable of solubilizing the alkyl chloride or bromide thereby facilitating reaction at the cathode. Preferably, too, the electrolyte is a solvent for dialkyltin dihalides and trialkyltin halides. Acetonitrile has been found satisfactory in all these respects. Other lower ($C_1$–$C_4$) alkano-nitriles such as propionitrile and butyronitrile can also be used. Other polar media that can be used include amides such as N,N-dimethylformamide, N,N-diethylacetamide, and hexamethyl phosphoramide.

Although polar nonaqueous and nonhydroxylic organic solvents are desirably employed for their inertness and ability to provide homogeneous media containing both the polar current-carrier and the relatively nonpolar alkyl halides, it is sometimes beneficial to include water or other hydroxylic component, such as alkanols having one to four carbon atoms, ethylene glycol, propylene glycol, glycerol, polyethyleneglycol or the like organic hydroxylic compound which is miscible with said polar nonaqueous solvent, in moderate amounts consonant with the desirability of maintaining a homogeneous electrolyte. The hydroxylic component tends to suppress breakup of the tin resulting in sludge formation. The amounts used in conjunction with nonaqueous organic solvents are usually in the range 1 to 5% by weight of the electrolyte composition although up to 20% by weight can be used to advantage.

Proportions of the various electrolyte components are not critical and can vary widely so long as there are sufficient quantities of each of the current-carrier, the solvent and the alkyl chloride or bromide to provide a conductive liquid medium and to produce the desired alkyltin chloride and bromide compositions in recoverable amounts. Normally, the electrolyte comprises from about 5 to 35 weight percent alkylating agent (preferably 10 to 30%), from about 1 to 20 weight percent current-carrier (preferably 5 to 15%) the remainder being solvent.

The reductive alkylation reaction proceeds under mild conditions and normally is conducted at temperatures of from 20° to 60°C. although temperatures as low as about 0°C. and as high as about 100°C. can be used if desired. The operating pressure should be sufficient to maintain both the electrolyte and the alkyl halide in the liquid phase. Atmospheric pressures generally suffice with the alkyl halides having four or more carbons; however, higher or lower pressures can be used provided the liquid nature of the electrolyte and the alkyl halide is maintained.

The following Examples illustrate the invention.

EXAMPLE 1

This Example illustrates the direct preparation of dimethyltin dibromide using dimethyltin dibromide as the sole current-carrier. In like manner, dimethyltin dichloride can be prepared with dimethyltin dichloride employed as the current carrier.

The electrolytic cell used herein was a circular undivided sandwich-type cell having a tin cathode and a graphite anode each with an area of 100 $cm^2$ and spaced about 1 cm. apart. The cell was equipped with means for circulating the electrolyte through it. The electrolyte, was circulated at a rate of about 500 ml./min.

The electrolyte, comprising 1000 grams of 30% methyl bromide, 65% acetonitrile, 3% glycerol and 2% dimethyltin dibromide, was circulated through the cell while being electrolyzed at a current density of 0.1 amp./$cm.^2$ for 60 minutes. During the run the electrolyte became deep orange, attributed to polybromide ion, and the temperature rose to 41°C. from 8°C. initially. It was found that 13.3 grams of tin was consumed from the cathode. The resulting electrolyte contained 2.53% of soluble tin compounds. Gas chromatographic analysis showed that 23% of the tin was in the form of newly produced dimethyltin dibromide product and 30% as trimethyltin bromide.

EXAMPLE 2

The procedure of Example 1 was repeated except that (a) the electrolyte consisted of 25 wt. % methyl bromide, 69 wt. % acetonitrile, 3 wt. % methanol and 3 wt. % tetraethylammonium bromide, (b) the reaction time was 90 minutes, and (c) the temperature was 25°C. initially, 50°C. finally. Polarographic analysis of the liquid electrolyte showed it contained substantially all of the tin lost from the cathode during the run in the form of electrolytesoluble products. Gas chromatographic analysis showed that the products consisted essentially of trimethyltin bromide (70%) and dimethyltin dibromide (30%).

EXAMPLE 3

The electrolysis procedure of Example 2 was repeated with an electrolyte consisting of methyl bromide 30%, acetonitrile 61%, 1% water, and tetraethylammonium bromide 8%. The resulting electrolyte was made strongly alkaline with aqueous sodium hydroxide and filtered to recover the tin alkylation products as dimethyltin oxide and bis(trimethyltin) oxide.

EXAMPLE 4

The procedure of Example 2 was repeated with an electrolyte consisting of 30% methyl bromide, 68% acetonitrile, 1% methanol and 1% lithium bromide. Some sludge formed during the run (1.06 g.). The tin loss from the cathode was 3.4 g. Gas chromatographic analysis of the electrolyte showed the presence of dimethyltin dibromide (amounting to 10% of the tin loss) and trimethyltin bromide (trace).

EXAMPLE 5

The electrolytic cell used herein was a circular undivided sandwich-type cell having a tin cathode and a graphite anode each with an area of 100 $cm^2$ and spaced about 1 cm apart. An electrolyte consisting of by weight:

1% tetraethylammonium chloride
3% tributyltin chloride
2% glycerol
30% n-butyl chloride
64% acetonitrile and initially cooled to 16°C., was circulated at a rate of about 500 ml./min. The current was turned on and adjusted to give a current density of 0.1 amp./$cm^2$; the total cell potential required was 11.5 volts. The current was passed for 45 min. or until 0.28 Faraday (4.18 electrons/tin atom) had passed. During this time, the electrolyte temperature rose to 37°C. and the voltage required fell to 8.5 volts. A dark precipitate formed during the run and was collected in a settling tank in the circulating stream. The total tin loss from the cathode was 8 g. (or .0673 g. atoms). Analysis of the liquid electrolyte showed it contained tributyltin chloride and dibutyltin dichloride, including complexes with tetraethylammonium chloride, $[(C_4H_9)_2SnCl_4]^{-2}$ $[(C_2H_5)_4N]_2^{+2}$.

EXAMPLE 6

The general procedures of Example 5 were followed using as the electrolyte a solution of 10% tetraethylammonium chloride, 30% ethyl chloride and 60% acetonitrile (1000 g. total). The tin loss was 14 g., current 0.279 Faraday (2.35 electrons/tin atom), current density 0.1 amp./$cm^2$ and the time 45 minutes. The temperature range was 18°–20°C.

On filtration there was removed a pyrophoric dark solid. The residual liquid electrolyte contained diethyltin dichloride and triethyltin chloride complexed with tetraethylammonium chloride.

The embodiments of the invention in which an exclusive property or privilege is claimed are defined as follows:

1. A process for preparing at least one tetravalent alkyltin halide having two to three alkyl groups and one to two halide groups per tin atom, comprising electrolyzing a $C_1$ to $C_{10}$ alkyl halide in contact with a tin cathode, in a liquid electrolyte containing a current-carrier source of halide ions, in an undivided cell at a current density of from 0.02 to 0.2 amp./$cm^2$.

2. A process according to claim 1 wherein the current-carrier is di($C_1$–$C_2$ alkyl) tin halide, comprising electrolyzing the $C_1$ to $C_{10}$ alkyl halide and producing a mixture of dialkyltin dihalide and trialkyltin halide.

3. A process according to claim 2 comprising electrolyzing a $C_1$ to $C_{10}$ alkyl halide and producing dialkyltin dihalide.

4. A process according to claim 2 comprising electrolyzing a $C_1$ to $C_{10}$ alkyl halide and producing trialkyltin halide.

5. A process according to claim 2 comprising recovering the mixture of dialkyltin dihalide and trialkyltin halide by distillation.

6. A process according to claim 3 wherein the current-carrier is di($C_1$–$C_2$ alkyl) tin dichloride and the product is dialkyltin dichloride.

7. A process according to claim 6 wherein the alkyl halide is methyl chloride, the current-carrier is dimethyltin dichloride and the product is dimethyltin dichloride.

8. A process according to claim 6 wherein the alkyl halide is ethyl chloride, the current-carrier is diethyltin dichloride and the product is diethyltin dichloride.

9. A process according to claim 3 wherein the current-carrier is di($C_1$–$C_2$ alkyl) tin dibromide and the product is dialkyltin dibromide.

10. A process according to claim 9 wherein the alkyl halide is methyl bromide, the current-carrier is dimethyltin dibromide and the product is dimethyltin dibromide.

11. A process according to claim 9 wherein the alkyl halide is ethyl bromide, the current-carrier is diethyltin dibromide and the product is diethyltin dibromide.

12. A process according to claim 1 comprising the additional step of reacting the tetravalent alkyltin halides with aqueous alkali and converting them to the corresponding electrolyte-insoluble tetravalent alkyltin oxides.

* * * * *

UNITED STATES PATENT OFFICE
CERTIFICATE OF CORRECTION

PATENT NO. : 3,954,576

DATED : May 4, 1976

INVENTOR(S) : Harris Ellsworth Ulery

It is certified that error appears in the above-identified patent and that said Letters Patent are hereby corrected as shown below:

Claim 1 should read as follows:

-- 1. A process for preparing at least one tetravalent alkyltin halide having 2 to 3 alkyl groups and 1 to 2 halide groups per tin atom, comprising electrolyzing a $C_1$ to $C_{10}$ alkyl halide in contact with a tin cathode, in an undivided cell at a current density of from 0.02 to 0.2 amp/$cm^2$ utilizing a liquid electrolyte containing no constituents which interfere with the step of alkylating tin, said electrolyte containing a current-carrier source of halide ions, and an aqueous or nonaqueous polar organic solvent for said current-carrier, said current-carrier being selected from at least one member of the group consisting of quaternary ammonium chlorides and bromides,
alkali metal chlorides and bromides,
dialkyltin dichlorides and dibromides, and
trialkyltin chlorides and bromides. --

Signed and Sealed this

Seventeenth Day of August 1976

[SEAL]

*Attest:*

RUTH C. MASON
*Attesting Officer*

C. MARSHALL DANN
*Commissioner of Patents and Trademarks*